US009254976B2

(12) United States Patent
Koga

(10) Patent No.: US 9,254,976 B2
(45) Date of Patent: Feb. 9, 2016

(54) DETECTION APPARATUS AND IMAGE FORMING APPARATUS

(71) Applicant: CANON KABUSHIKI KAISHA, Tokyo (JP)

(72) Inventor: Satoshi Koga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/484,541

(22) Filed: Sep. 12, 2014

(65) Prior Publication Data

US 2015/0102551 A1 Apr. 16, 2015

(30) Foreign Application Priority Data

Oct. 15, 2013 (JP) ..... 2013-214371

(51) Int. Cl.
*B65H 7/08* (2006.01)
*B65H 7/06* (2006.01)

(52) U.S. Cl.
CPC ..... *B65H 7/06* (2013.01); *B65H 2402/541* (2013.01); *B65H 2403/53* (2013.01); *B65H 2404/611* (2013.01); *B65H 2553/41* (2013.01); *B65H 2553/412* (2013.01); *B65H 2553/612* (2013.01)

(58) Field of Classification Search
CPC ..... B65H 43/08; B65H 2553/41; B65H 2553/412; B65H 2553/612
See application file for complete search history.

(56) References Cited

U.S. PATENT DOCUMENTS 5,329,119 A * 7/1994 Swartz et al. ..... 250/229
5,923,140 A * 7/1999 Azumi et al. ..... 318/640

FOREIGN PATENT DOCUMENTS

JP 2008-150149 A 7/2008
JP 4750684 B2 8/2011

* cited by examiner

*Primary Examiner* — Howard Sanders
(74) *Attorney, Agent, or Firm* — Fitzpatrick, Cella, Harper & Scinto

(57) ABSTRACT

A detection apparatus includes a rotating member which rotates in a rotation direction from a standby posture by being pushed by a conveyed sheet, a sensor of which an output is changed as the rotating member rotates from the standby posture, an elastic member which elastically applies a force to the rotating member in a direction opposite to the rotation direction, a first abutting portion which abuts onto the rotating member applied by a force by the elastic member to maintain the rotating member in the standby posture, and a regulation unit which allows the rotating member to rotate in the rotation direction by being pushed by the conveyed sheet and regulates the rotating member not to rotate in the rotation direction by a repulsion force when the rotating member rotated in the opposite direction by an elastic force of the elastic member abuts onto the first abutting portion.

8 Claims, 10 Drawing Sheets

200
+r2
X
212
213
212a
202
202b
210a
203
205
204
212b
210b
210
201
210d
211
+r1
210c
L
G
-r1

DETECTION APPARATUS AND IMAGE FORMING APPARATUS

BACKGROUND OF THE INVENTION

1. Field of the Invention

The present invention relates to a detection apparatus which is used in an image forming apparatus such as a copying machine, a printer, and a facsimile apparatus.

2. Description of the Related Art

In general, the image forming apparatus such as the copying machine, the printer, the facsimile apparatus is provided with a sheet detecting apparatus which detects a timing point at which a sheet passes when the sheet is conveyed as a recording medium.

In the image forming apparatus, the sheet detecting apparatus detects a timing point at which the sheet passes in order to determine jamming, multiple feeding, or the like.

In general, the sheet detecting apparatus is configured to include a rotatable sensor lever and an optical sensor such as a photo interrupter. The sensor lever is applied by a force in a direction abutting onto the sheet, and is rotatably pushed down when the sheet passes through. Therefore, the photo interrupter is operated such that a detection area of the photo interrupter is closed or opened, and thus a leading edge of the passing sheet is detected. Such a type of sheet detecting apparatus, for example, is disclosed in Japanese Patent Laid-Open No. 2008-150149.

However, the sheet detecting apparatus disclosed in Japanese Patent Laid-Open No. 2008-150149 has problems as follows.

When returning to a home position after the sheet passes through, the sensor lever comes into conflict with a stopper which defines the home position of the sensor lever and thus is rebounded. At this time, the sensor lever transects the detection area of the photo interrupter several times, so that a chattering phenomenon that a detection signal generated from the photo interrupter is repeatedly turned on/off may occur.

Specifically, in a case where a plurality of sheets is successively conveyed, when the leading edge of the following sheet is arrived at the sensor lever before the chattering is lessened, the leading edge of the following sheet is not correctly detected.

Therefore, in the related art, a sheet conveying speed and an inter-sheet distance is necessarily set by estimating a time taken for lessening the chattering, so that there is a limitation in increasing the sheet conveying speed and an image forming speed.

The invention has been made in view of the above circumstances, and it is desirable to provide a detection apparatus which prevents an erroneous detection due to the chattering.

SUMMARY OF THE INVENTION

A representative configuration of a detection apparatus according to the invention includes a rotating member which rotates in a rotation direction from a standby posture by being pushed by a conveyed sheet, a sensor of which the output is changed as the rotating member rotates from the standby posture, an elastic member which elastically applies a force to the rotating member in a direction opposite to the rotation direction, a first abutting portion which abuts onto the rotating member applied by a force by the elastic member to maintain the rotating member in the standby posture, and a regulation unit which allows the rotating member to rotate in the rotation direction by being pushed by the conveyed sheet and regulates the rotating member not to rotate in the rotation direction by a repulsion force when the rotating member rotated in the opposite direction by an elastic force of the elastic member abuts onto the first abutting portion.

Further features of the present invention will become apparent from the following description of exemplary embodiments with reference to the attached drawings.

DESCRIPTION OF THE EMBODIMENTS

Embodiments of a detection apparatus according to the invention and an image forming apparatus which includes the detection apparatus will be described in detail with reference to the drawings. In the following embodiments, an electrophotographic laser printer will be described in detail as an example of the image forming apparatus which includes the detection apparatus according to the invention.

However, there is no purpose of limiting the scope of the invention only to dimensions, materials, shapes, and relative arrangements of the components described in the following embodiments if not otherwise specified. Further, the detection apparatus according to the invention is not limited only to the laser printer, and may be applied to other various types of image forming apparatuses such as a copying machine and a facsimile apparatus.

[First Embodiment]

First, a configuration of a first embodiment of a detection apparatus according to the invention and an image forming apparatus which includes the detection apparatus will be described using FIGS. 1 to 6.

<Configuration and Operation of Image Forming Apparatus>

Figure 1:
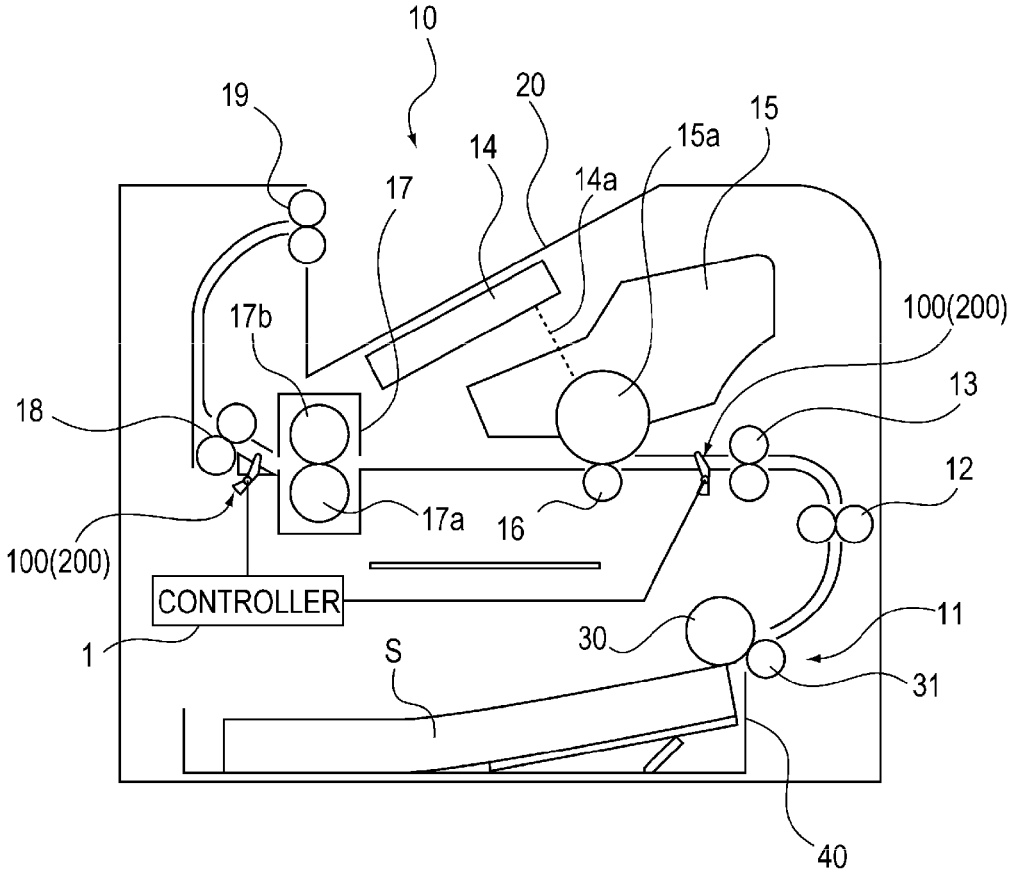
FIG. 1 is a cross-sectional view for describing a configuration of an image forming apparatus which includes a detection apparatus according to the invention.

FIG. 1 is a cross-sectional view schematically illustrating the entire structure of an image forming apparatus 10 serving as a laser printer. The image forming apparatus 10 includes a sheet cassette 40 which contains sheets S. Further, the image forming apparatus 10 includes a sheet conveyance path as an image forming portion which conveys the sheet S and forms an image fixedly onto the sheet S, an image forming portion which forms an image, and a fixing apparatus 17 which fixes the image.

A sheet separation portion 11 conveys the sheets S contained in the sheet cassette 40 separately one by one in cooperation with a feed roller 30 and a separation roller 31 which are provided in the sheet separation portion 11. Then, through conveying rollers 12 and 13 serving as a sheet conveyance portion, the sheet S is fed to a nip portion formed between a photosensitive drum 15*a* as an image bearing member serving as the image forming portion and a transfer roller 16 serving as a transfer portion.

The image forming portion includes an exposure apparatus 14, a process cartridge 15, and the transfer roller 16. The process cartridge 15 includes the photosensitive drum 15*a*, a charging portion (not illustrated), and a developing portion. The photosensitive drum 15*a* is formed in a metal cylinder of which the surface is formed by a photosensitive layer having a negative charge polarity.

The charging portion makes the surface of the photosensitive drum 15*a* serving as the image bearing member charged evenly. The exposure apparatus 14 irradiates the surface of the photosensitive drum 15*a* with a laser beam 14*a* depicted with a broken line of FIG. 1 based on image information, and thus forms an electrostatic latent image. The developing portion causes toner to be attached onto the electrostatic latent image formed on the surface of the photosensitive drum 15*a*, and visualizes the electrostatic latent image as a toner image. The transfer roller 16 transfers the toner image on the surface of the photosensitive drum 15*a* onto the sheet S.

The fixing apparatus 17 includes a pressure roller 17*a* and a fixing roller 17*b* having a heater built therein. The fixing apparatus 17 applies heat and pressure onto the sheet S which passes through a nip portion between the pressure roller 17*a* and the fixing roller 17*b*, and makes the transferred toner image fixed onto the sheet S. Then, the sheet S is sent to a discharge roller 19 by a conveying roller 18 and discharged onto a discharge tray 20.

As illustrated in FIG. 1, a sheet detecting apparatus 100 is provided at a predetermined position on the sheet conveyance path of the sheet S to detect a timing point of the sheet S passing that position. Then, a sheet conveyance fail such as jamming or multiple feeding is detected by detecting the sheet S using the sheet detecting apparatus 100.

<Sheet Detecting Apparatus>

Figure 2A:
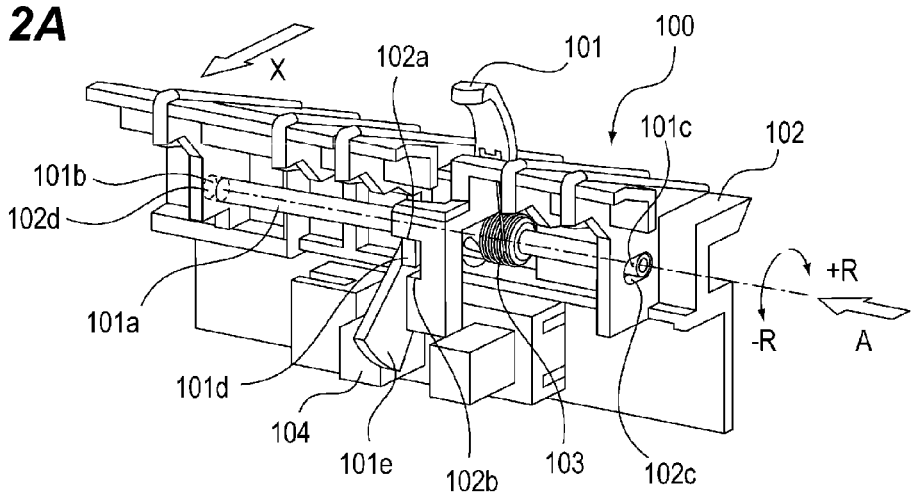
FIG. 2A is a perspective view for describing a sheet detecting operation in a first embodiment of the detection apparatus according to the invention.
Figure 2B:
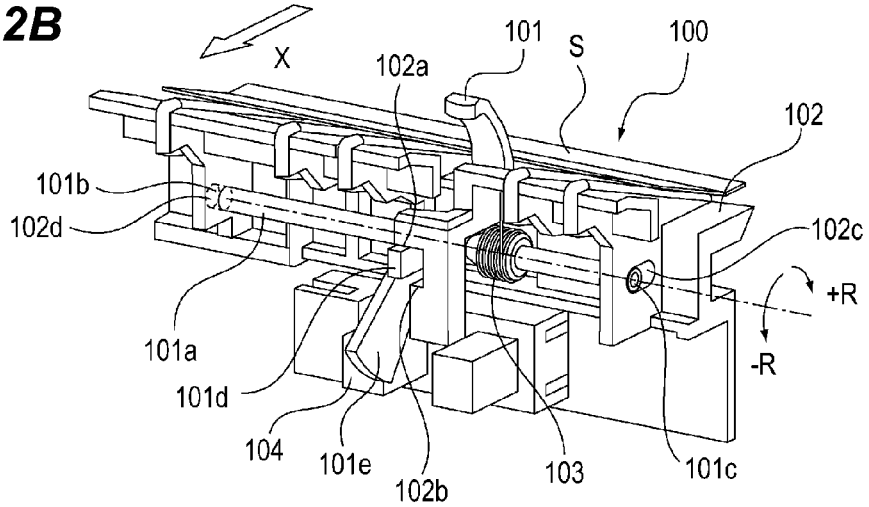
FIG. 2B is a perspective view for describing the sheet detecting operation in the first embodiment of the detection apparatus according to the invention.
Figure 2C:
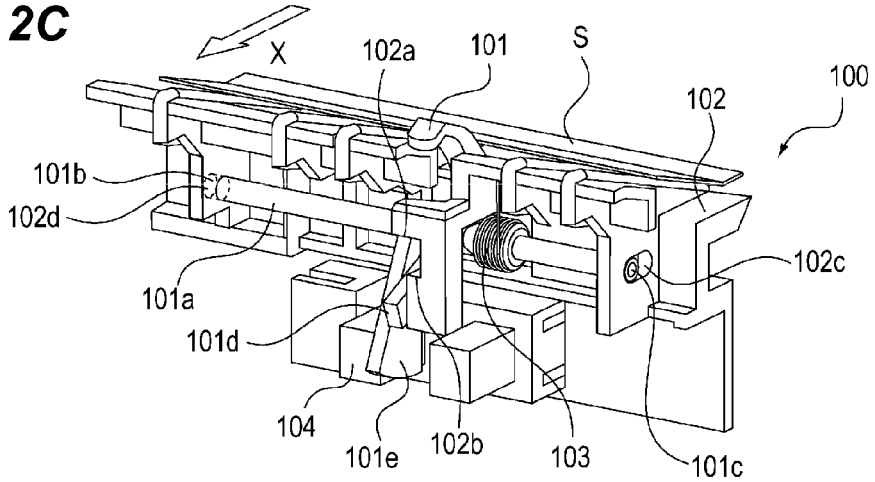
FIG. 2C is a perspective view for describing the sheet detecting operation in the first embodiment of the detection apparatus according to the invention.
Figure 3A:
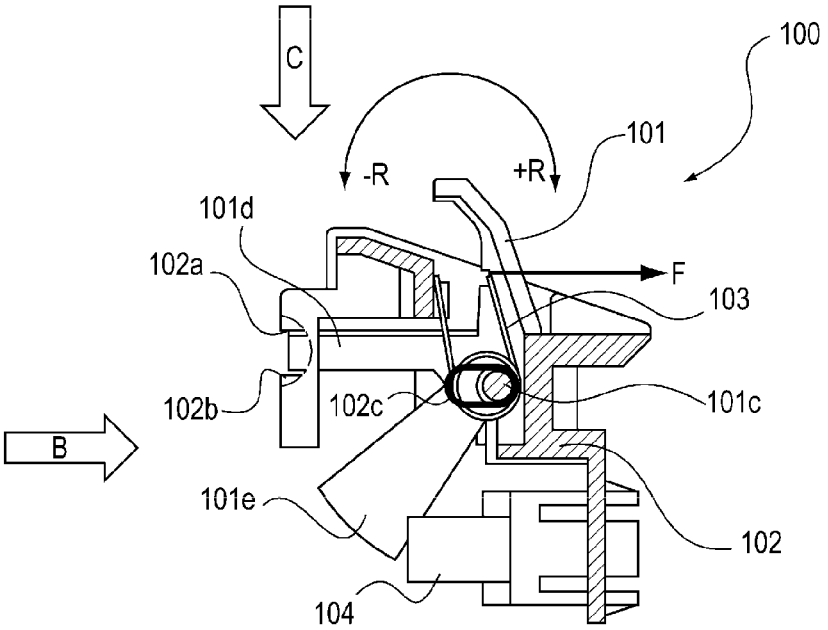
FIG. 3A is a cross-sectional view for describing the sheet detecting operation in the first embodiment when viewed in a direction of arrow A of FIG. 2A.
Figure 3B:
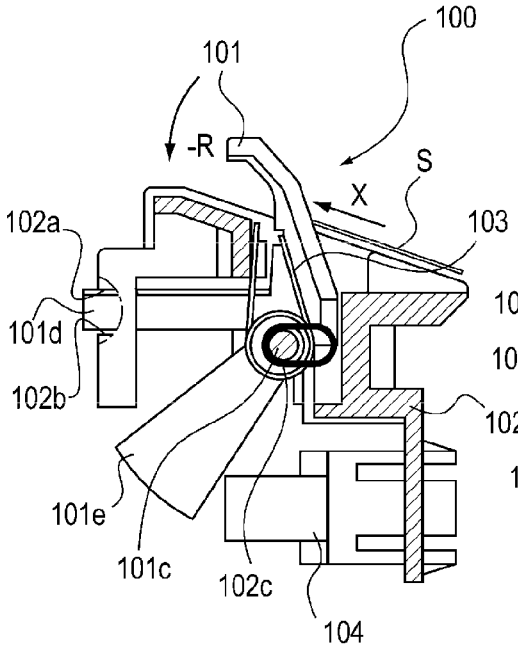
FIG. 3B is a cross-sectional view for describing the sheet detecting operation in the first embodiment when viewed in the direction of arrow A of FIG. 2A.
Figure 3C:
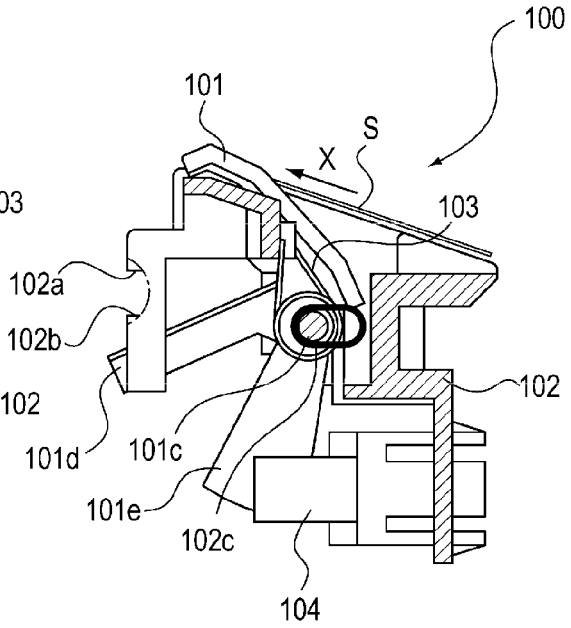
FIG. 3C is a cross-sectional view for describing the sheet detecting operation in the first embodiment when viewed in the direction of arrow A of FIG. 2A.

Next, a configuration of the sheet detecting apparatus 100 of the embodiment will be described using FIGS. 2 to 6. FIGS. 2A to 2C are diagrams for describing the operation of the sheet detecting apparatus 100. FIGS. 3A to 3C are cross-sectional views when viewed from a direction of arrow A of FIG. 2A.

Figure 4:
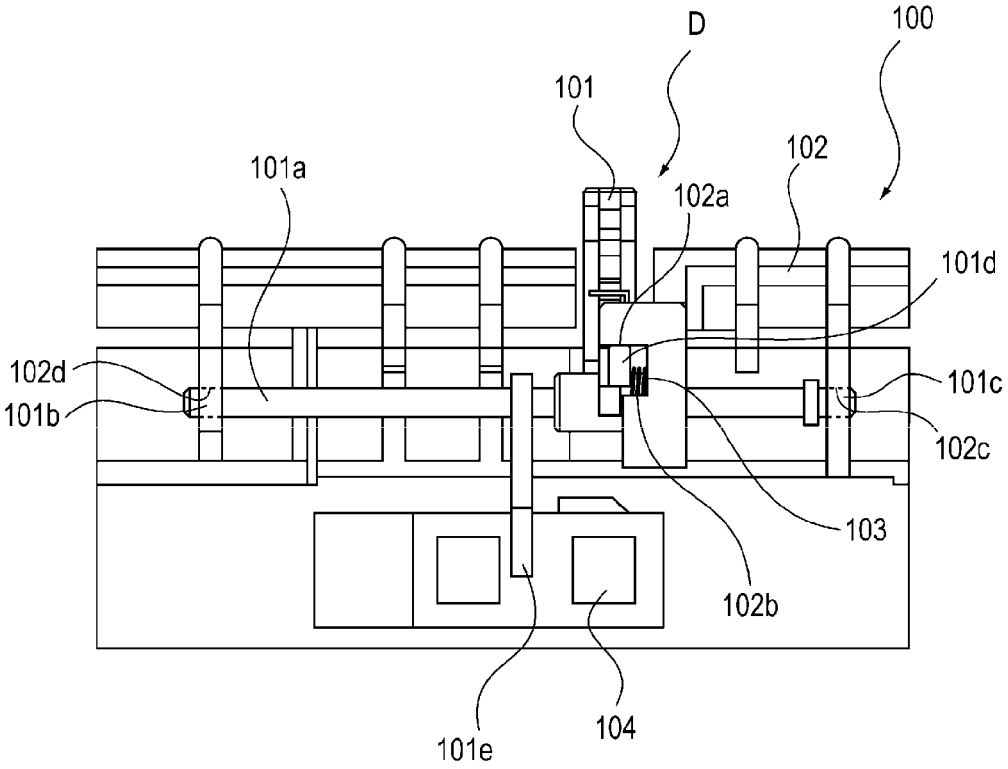
FIG. 4 is a front view of the detection apparatus of the first embodiment when viewed from a direction of arrow B of FIG. 3A.
Figure 5A:
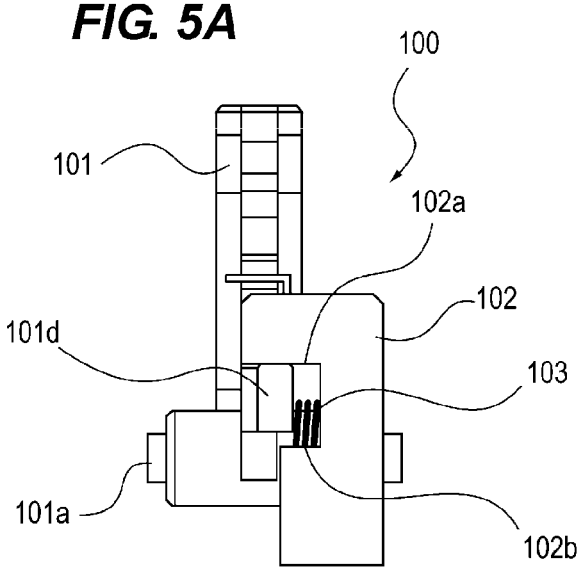
FIG. 5A is an enlarged view of a portion indicated with D of FIG. 4 for describing the sheet detecting operation in the first embodiment.
Figure 5B:
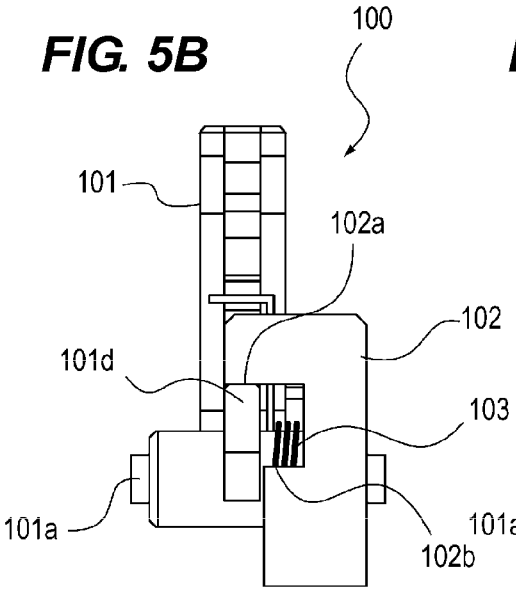
FIG. 5B is an enlarged view of the portion indicated with D of FIG. 4 for describing the sheet detecting operation in the first embodiment.
Figure 5C:
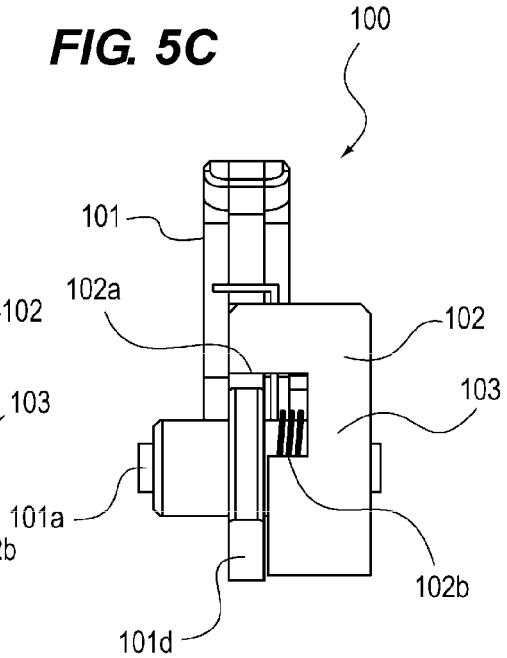
FIG. 5C is an enlarged view of the portion indicated with D of FIG. 4 for describing the sheet detecting operation in the first embodiment.
Figure 6A:
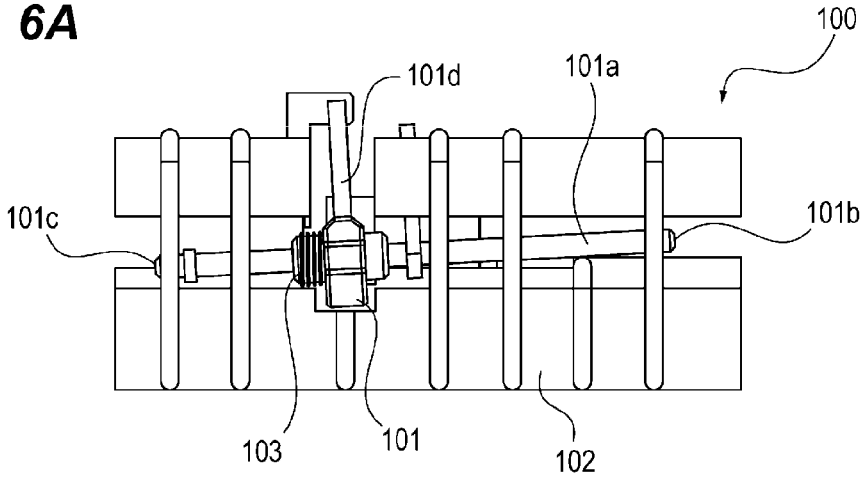
FIG. 6A is a plan view for describing the sheet detecting operation in the first embodiment when viewed from a direction of arrow C of FIG. 3A.
Figure 6B:
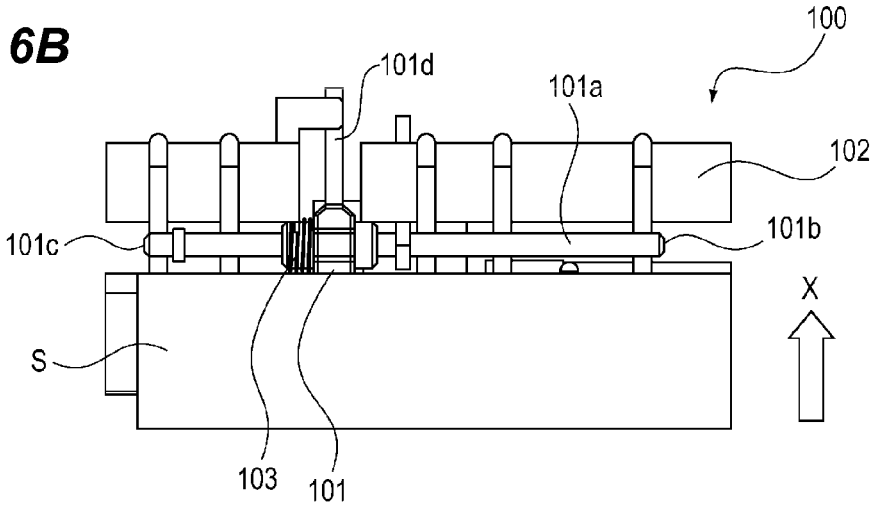
FIG. 6B is a plan view for describing the sheet detecting operation in the first embodiment when viewed from the direction of arrow C of FIG. 3A.
Figure 6C:
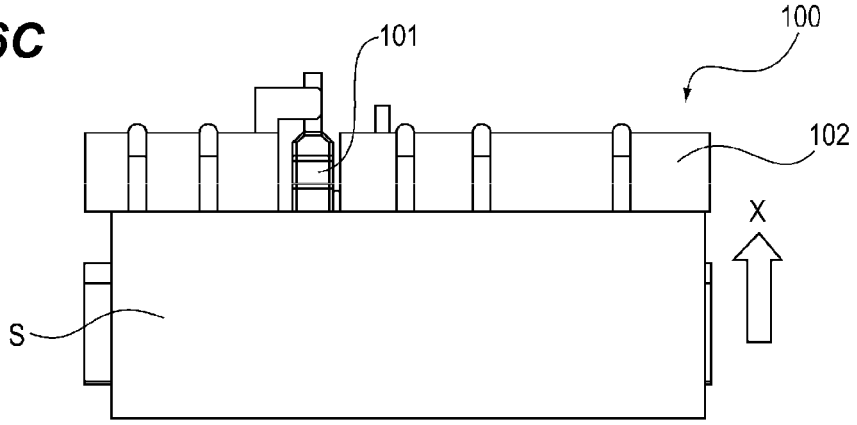
FIG. 6C is a plan view for describing the sheet detecting operation in the first embodiment when viewed from the direction of arrow C of FIG. 3A.

FIG. 4 is a diagram when viewed from a direction of arrow B of FIG. 3A. FIGS. 5A to 5C are enlarged views illustrating a portion indicated with D of FIG. 4. FIGS. 6A to 6C are diagrams when viewed from a direction of arrow C of FIG. 3A. FIGS. 2A, 3A, 5A, and 6A each illustrate a standby state.

FIGS. 2B, 3B, 5B, and 6B each illustrate a state where a sensor lever is pushed by the sheet S and a regulation unit is released. FIGS. 2C, 3C, 5C, and 6C each illustrate a state where the sheet S passes through while pushing the sensor lever.

First, using FIGS. 2A and 3A, the configuration of the sheet detecting apparatus 100 and the state of the sheet detecting apparatus 100 before the sheet S is arrived (standby state) will be described.

The sheet detecting apparatus 100 includes a sensor lever (rotating member) 101 which rotates about a rotation shaft 101*a* from a standby posture by being pushed by the sheet S, and a supporting member 102 which supports the sensor lever 101 to freely rotate about the rotation shaft 101*a*. The sensor lever 101 includes a sheet abutting portion which abuts on the conveyed sheet S.

Further, the sensor lever 101 includes a torsion coil spring (an elastic member) 103 serving as an urging portion to elastically apply a force to the sensor lever 101 in a direction opposite to the rotation direction of the sensor lever 101 which is pushed by the sheet S and rotates about the rotation shaft 101*a*.

Further, the sensor lever 101 is configured to include a photo interrupter 104 serving as a sensor which detects the rotating of a blocking portion of the sensor lever 101. The output of the photo interrupter 104 is changed while the sensor lever 101 rotates from the standby posture.

A fixed end (one side) 101*b* which is one end of the rotation shaft 101*a* of the sensor lever 101 is fitted and supported to a round hole 102*d* (a first hole) illustrated in FIGS. 2A to 2C and FIG. 4 provided in the supporting member 102 to be freely rotated. Further, a movable end (the other side) 101*c* which is the other end of the rotation shaft 101*a* is supported by a long hole (a second hole) 102*c* provided in the supporting member 102 to be freely rotated, and is inserted into the long hole 102*c* to be movable along the hole.

The supporting member 102 supports the rotation shaft 101*a* using the round hole 102*d* and the long hole 102*c*, so that the rotation shaft 101*a* is movable in a conveyance direction X of the sheet S. Regarding the sizes of the round hole 102*d* and the long hole 102*c* in the conveyance direction X of the sheet S, the long hole 102*c* is configured to be larger than that of the round hole 102*d*. When the sensor lever 101 is pushed by the sheet S, the rotation shaft 101*a* moves in a posture inclined with respect to a direction perpendicular to the conveyance direction X of the sheet S. Specifically, the movable end (the other side) 101*c* moves in the conveyance direction X of the sheet S along the long hole 102*c*. In other words, the movable end 101*c* of the rotation shaft 101*a* moves with respect to a fixed end 101*b*.

The sensor lever 101 is applied by a force from the torsion coil spring 103 in a direction of arrow +R in FIGS. 2A and 3A which is opposite to a rotating direction (the direction of arrow −R in FIGS. 2A and 3A) when the sensor lever 101 is pushed by the sheet S. An upper face (a first abutted portion) 101*d*1 of an arm portion 101*d* of the sensor lever 101 abuts onto a stopper (a first abutting portion) 102*a* provided in the supporting member 102, so that the rotating of the sensor lever 101 in the direction of arrow +R in FIGS. 2A and 3A is regulated. The stopper 102*a* fixes the sensor lever 101 applied by a force in a direction opposite to the rotating direction when the sensor lever 101 is pushed to the sheet S in order to be maintained at the home position as the standby posture by the torsion coil spring 103.

When the rotating of the sensor lever 101 is regulated by the stopper 102*a*, the torsion coil spring 103 is disposed to apply an urging force F in direction of arrow B in FIG. 3A with respect to the sensor lever 101. As illustrated in FIG. 3A, the movable end 101*c* of the rotation shaft 101*a* of the sensor lever 101 in the standby state illustrated in FIG. 3A enters a state of being biased by the urging force F toward the right end of the long hole 102*c* formed in the supporting member 102 in FIGS. 3A to 3C. Therefore, in the standby state illustrated in FIG. 6A, the sensor lever 101 and the rotation shaft 101*a* enter a state of being slightly inclined with respect to a direction perpendicular to the sheet conveyance direction X.

The sensor lever 101 of the standby state illustrated in FIG. 2A is pushed by the sheet S and rotates about the rotation shaft 101*a*. Further, the sensor lever 101 rotates about the rotation shaft 101*a* in a direction of arrow −R in FIG. 2B as illustrated in FIG. 2B. In this case, as illustrated in FIG. 5A, in a case where the sensor lever 101 rotates while the rotation shaft 101*a* is in the inclined state, a lower face (a second abutted portion) 101*d*2 of the arm portion 101*d* of the sensor lever 101 runs into a repulsion preventing face (the second abutted portion) 102*b* which is provided in the supporting member 102. Therefore, the arm portion 101*d* of the sensor lever 101 is regulated by the stopper 102*a* and the repulsion preventing face 102*b*, and the sensor lever 101 enters a lock state in which the sensor lever 101 is not allowed to rotate about the rotation shaft 101*a* in any direction of arrow −R or +R in FIG. 2B.

In the first embodiment, the regulation unit allows the sensor lever 101 to rotate in the rotation direction (a rotating direction when being pushed by the sheet S) thereof by being pushed by the conveyed sheet S, and regulates the sensor lever 101 not to rotate in the rotation direction by a repulsion force generated when the upper face 101*d*1 of the arm portion 101*d* of the sensor lever 101 rotated in the opposite direction by an elastic force of the torsion coil spring 103 abuts onto the stopper 102*a*. The regulation unit is configured as follows.

In other words, the regulation unit includes the round hole 102*d* illustrated in FIGS. 2A to 2C and FIG. 4 which rotatably supports the fixed end 101*b* of the rotation shaft 101*a* of the sensor lever 101. Further, the regulation unit includes the long hole 102*c* which supports the movable end 101*c* of the rotation shaft 101*a* to be freely rotated and moved in the sheet conveyance direction X.

Further, the regulation unit includes the repulsion preventing face 102*b* which abuts onto the lower face 101*d*2 of the arm portion 101*d* when the sensor lever 101 rotates in the rotation direction by the repulsion force generated when the upper face 101*d*1 of the arm portion 101*d* of the sensor lever 101 rotated in the opposite direction by the elastic force of the torsion coil spring 103 abuts onto the stopper 102*a*.

Further, the sensor lever 101 takes a regulating posture (FIG. 5A) in which the lower face 101*d*2 of the arm portion 101*d* abuts onto the repulsion preventing face 102*b* when rotating in the rotation direction and thus the rotating in the rotation direction is regulated, and an allowing posture (FIG. 5B) in which the lower face 101*d*2 of the arm portion 101*d* does not abut onto the repulsion preventing face 102*b* when the sensor lever 101 rotates in the rotation direction.

When the sensor lever 101 is pushed by the sheet S, the movable end 101*c* of the rotation shaft 101*a* moves in the conveyance direction X of the sheet S along the long hole 102*c*, so that the sensor lever 101 changes its posture from the regulating posture to the allowing posture.

Further, there is a lock released state (a second position) illustrated in FIG. 5B, in which the sensor lever 101 is pushed by the sheet S and thus rotatable about the rotation shaft 101*a*.

Then, the sheet S pushes the sensor lever 101 to rotate about the rotation shaft 101*a* and causes the sensor lever 101 to be changed in its state from the standby state (a first position) illustrated in FIG. 5A to the lock released state (the second position) illustrated in FIG. 5B. Therefore, the rotation prevention of the regulation unit is released.

<Release of Regulation Unit>

Next, a process of releasing the regulation unit when the sensor lever 101 is pushed and rotated by the sheet S will be described using FIGS. 2B, 3B, 5B, and 6B. As illustrated in FIG. 3B, a leading edge of the sheet S abuts onto the sensor lever 101.

Then, the sensor lever 101 is pushed by the sheet S and forced in the sheet conveyance direction X. Then, the movable end 101*c* of the rotation shaft 101*a* of the sensor lever 101 moves as follows. In other words, the movable end 101*c* moves toward the left end of the long hole 102*c* on a downstream side in the sheet conveyance direction X in FIG. 3B along the long hole 102*c* which is provided in the supporting member 102 illustrated in FIG. 3B and serves as a release portion for releasing a locked (engaged) state.

At this time, as illustrated in FIG. 5B, the arm portion 101*d* of the sensor lever 101 moves to the position at which the arm portion 101*d* does not abut onto the repulsion preventing face 102*b*. Therefore, the sensor lever 101 is rotatable in a direction of arrow −R in FIG. 3B, and the regulation unit enters the released state.

As illustrated in FIG. 3C, further, when the sheet S is conveyed, the sensor lever 101 rotates about the rotation shaft 101*a* to the position illustrated in FIGS. 2C, 3C, 5C, and 6C. At this time, as illustrated in FIG. 3C, a flag portion (a blocking portion) 101*e* provided in the sensor lever 101 goes into a light path generated between a light emitting element and a light receiving element of the photo interrupter 104 to block the light path, and thus a sensor signal generated from the photo interrupter 104 is changed from ON to OFF. When receiving the signal, a controller 1 determines that the leading end of the sheet S is arrived.

<Return to Home Position>

Next, a process in which the sensor lever 101 returns to the home position after the sheet S passes through the sheet detecting apparatus 100 will be described using FIGS. 2A, 3A, 5A, and 6A. The sheet S passes through the sheet detecting apparatus 100 from the state where the sheet S illustrated in FIG. 3C is passing, and then the sheet S is separated from the sensor lever 101. Then, the sensor lever 101 rotates about the rotation shaft 101*a* in a direction of arrow +R illustrated in FIG. 3A by the urging force F of the torsion coil spring 103. At the same time, the movable end 101*c* of the rotation shaft 101*a* moves to the right end of FIG. 3A along the long hole 102*c*.

Therefore, as illustrated in FIG. 5A, the arm portion 101*d* of the sensor lever 101 comes into conflict with the stopper 102*a* of the supporting member 102. In other words, the sensor lever 101 returns to the posture in the standby state illustrated in FIGS. 2A, 3A, 5A, and 6A.

As illustrated in FIG. 3A, the movable end 101*c* of the rotation shaft 101*a* of the sensor lever 101 is on the upstream side (the right end side of FIG. 3A) of the long hole 102*c* of the supporting member 102 in the sheet conveyance direction X. In this state, the sensor lever 101 rotates about the rotation shaft 101*a* in a direction of arrow +R in FIG. 3A by the urging force F of the torsion coil spring 103, and the arm portion 101*d* of the sensor lever 101 comes into conflict with the stopper 102*a* as illustrated in FIG. 5A.

Then, the sensor lever 101 is applied by the repulsion force from the stopper 102*a* to rotate about the rotation shaft 101*a* in a direction of arrow −R in FIG. 3A. However, as illustrated in FIG. 5A, the arm portion 101*d* of the sensor lever 101 runs into the repulsion preventing face 102*b* provided in the supporting member 102.

Therefore, the rotating can be made only in a clearance formed between the stopper 102*a* and the repulsion preventing face 102*b*. At a turning position where the arm portion 101*d* of the sensor lever 101 abuts onto the repulsion preventing face 102*b*, the flag portion 101*e* of the sensor lever 101 is not arrived at a position blocking the light path formed between the light emitting element and the light receiving element of the photo interrupter 104.

That is, at this time, the flag portion is disposed at a position where the sensor signal generated from the photo interrupter 104 is not turned off. Therefore, a chattering phenomenon that the sensor signal generated from the photo interrupter 104 is repeatedly turned on/off does not occur.

In the embodiment, as illustrated in FIG. 5A, the arm portion 101*d* of the sensor lever 101 is trapped between the stopper 102*a* and the repulsion preventing face 102*b* by a conveying force of the sheet S, so that the sensor lever 101 enters the standby state in which the rotation about the rotation shaft 101*a* is not allowed.

From this state, as illustrated in FIGS. 5B and 5C, the arm portion 101*d* of the sensor lever 101 moves to a position departing from the position facing the repulsion preventing face 102*b* and enters a state in which the rotation about the rotation shaft 101*a* is allowed.

In other words, the sensor lever 101 is pushed by the sheet S and the rotation prevention by the regulation unit is released. Therefore, the sensor lever 101 comes to be rotatable.

Therefore, after the sheet S passes through the sheet detecting apparatus 100, the sensor lever 101 returns to the standby state illustrated in FIG. 3A by the urging force F of the torsion coil spring 103.

At this time, even though the arm portion is urged to rebound after coming into conflict with the stopper 102*a* which regulates the home position of the sensor lever 101, the rebounding is prevented (regulated) by the repulsion preventing face 102*b* included in the regulation unit. In other words, since the repulsion preventing face 102*b* regulates the rotation of the sensor lever 101, the vibration of the sensor lever 101 is prevented when the sensor lever 101 returns to the standby posture. Therefore, it is possible to prevent the chattering phenomenon that the sensor signal generated from the photo interrupter 104 is repeatedly turned on/off.

In the embodiment, the sensor lever 101 is configured to be applied by the urging force F from the torsion coil spring 103 serving as the urging portion and thus rotates about the rotation shaft 101*a* in a direction of arrow +R in FIG. 3A, and then returns to the standby state illustrated in FIG. 3A. Further, the sensor lever 101 may be configured to be applied by a force using its own weight without using the urging portion so as to be applied by a force to rotate about the rotation shaft 101*a* in a direction of arrow +R in FIG. 3A, and returns to the standby state illustrated in FIG. 3A.

[Second Embodiment]

Next, the configuration of a second embodiment of an image forming apparatus which includes the detection apparatus according to the invention will be described using FIGS. 7 to 10. Further, the same components as those in the first embodiment are denoted with the same reference numerals or assigned with the same member names even though the reference numerals are different, and the descriptions thereof will not be repeated.

In the first embodiment, the movable end 101*c* of the rotation shaft 101*a* of the sensor lever 101 is moved by the conveying force of the sheet S in the sheet conveyance direction X with respect to the fixed end 101*b*.

Then, the arm portion 101*d* of the sensor lever 101 is moved to a position at which the arm portion 101*d* faces the repulsion preventing face 102*b*. Therefore, the rotation of the sensor lever 101 is locked.

Further, the movable end 101*c* of the rotation shaft 101*a* of the sensor lever 101 is moved on the opposite side by the conveying force of the sheet S. Then, the arm portion 101*d* of the sensor lever 101 is moved to a position departing from the repulsion preventing face 102*b*. Therefore, the rotation of the sensor lever 101 is released from its locked state.

A sheet detecting apparatus 200 of the embodiment is configured such that a lock release lever (a release portion) 212 is rotatably provided in a lever body portion 210 and the rotation prevention by the regulation unit is released when the sheet S moves the lock release lever 212.

Figure 7:
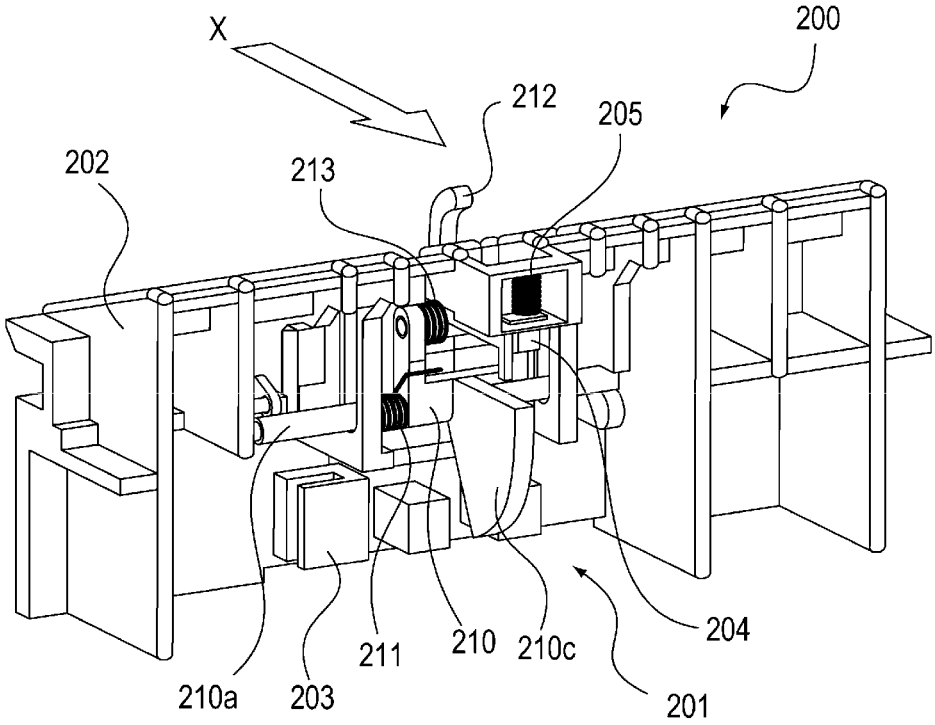
FIG. 7 is a perspective view for describing a configuration of a second embodiment of the detection apparatus according to the invention.

FIG. 7 is a perspective view of the sheet detecting apparatus 200 of the embodiment. In the sheet detecting apparatus 200, the lock release lever 212 which rotates about a rotation shaft 212*a* is provided in a sensor lever 201 which is pushed and rotated by the sheet S. The lever body portion 210 of the sensor lever 201 is supported to a supporting member 202 to freely rotate about a rotation shaft 210*a*.

Further, the sheet detecting apparatus is configured to include a photo interrupter 203 serving as a sensor to detect the rotation of the sensor lever 201, and a lock pin 204 which is provided at one end of a compression spring 205 of which the other end is provided in the supporting member 202.

Figure 8:
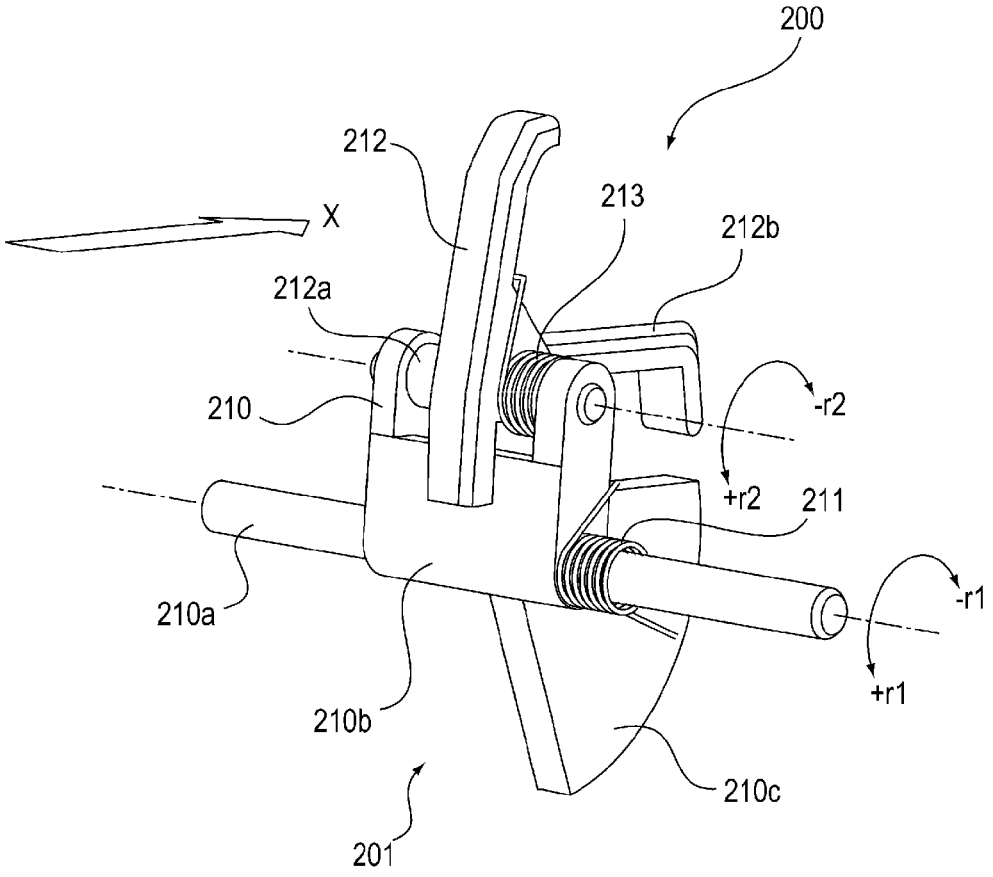
FIG. 8 is a perspective view for describing a configuration of a sensor lever and a lock release lever of the second embodiment.

FIG. 8 is a perspective view illustrating the configuration of the sensor lever 201. The sensor lever 201 includes the lever body portion 210 which is provided with a flag portion 210*c* to block a light path formed between a light emitting element and a light receiving element of the photo interrupter 203.

Further, a torsion coil spring 211 serving as an urging portion is provided to apply a force to the lever body portion 210 to rotate about the rotation shaft 210*a* in a direction of arrow +r1 in FIG. 8.

Further, the lock release lever 212 is provided to support the lever body portion 210 to freely rotate about the rotation shaft 212*a*.

Figures 9A, 9B, 9C:
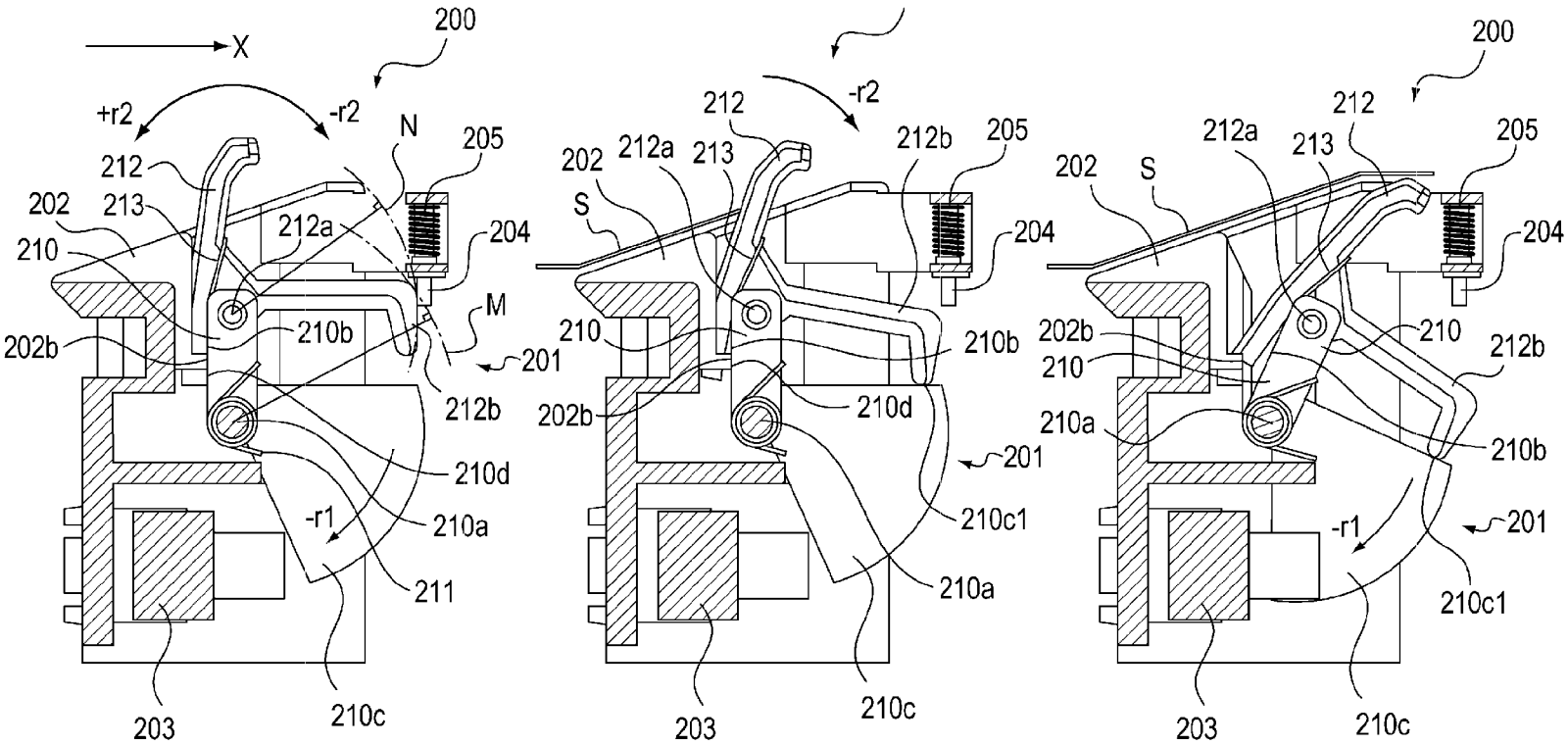
FIG. 9A is a cross-sectional view for describing a sheet detecting operation in the second embodiment.
FIG. 9B is a cross-sectional view for describing the sheet detecting operation in the second embodiment.
FIG. 9C is a cross-sectional view for describing the sheet detecting operation in the second embodiment.

Further, a torsion coil spring 213 serving as an urging portion is provided to apply a force to the lock release lever 212 to rotate about the rotation shaft 212*a* in a direction of arrow +r2 in FIGS. 8 and 9A.

Herein, an urging force of the torsion coil spring 211 which is applied to the lever body portion 210 to rotate about the rotation shaft 210*a* in a direction of arrow +r1 in FIG. 8 is as follows.

In other words, the urging force of the torsion coil spring 211 is set to be larger than that of the torsion coil spring 213 which is applied to the lock release lever 212 to rotate about the rotation shaft 212*a* in a direction of arrow +r2 in FIGS. 8 and 9A.

FIGS. 9A to 9*c* are cross-sectional views for describing the operation of the sheet detecting apparatus 200, in which FIG. 9A illustrates the standby state, FIG. 9B illustrates a state in which the regulation unit is released by the sheet S, and FIG. 9C illustrates a state in which the sheet S is passing through.

First, the sheet detecting apparatus 200 in the standby state illustrated in FIG. 9A will be described. In the standby state, an abutting portion 210*d* of the lever body portion 210 abuts onto a stopper 202*b* of the supporting member 202 to regulate the rotation of the lever body portion 210.

Further, the lock release lever 212 abuts onto an abutting portion 210*b* of the lever body portion 210 and is regulated in its rotation. A locus when the leading edge of an arm portion 212*b* of the lock release lever 212 rotates about the rotation shaft 210*a* of the lever body portion 210 of the sensor lever 201 in the standby state of the sensor lever 201 is illustrated by a locus M in FIG. 9A. Further, a locus when the leading edge of the arm portion 212*b* of the lock release lever 212 rotates about the rotation shaft 212*a* of the lock release lever 212 is illustrated by a locus N in FIG. 9A.

The lock pin 204 is disposed at a position where the lock pin 204 interferes in the locus M illustrated in FIG. 9A and does not interfere in the locus N. In the standby state illustrated in FIG. 9A, in a case where the lever body portion 210 of the sensor lever 201 rotates bout the rotation shaft 210*a* in a direction of arrow −r1 in FIG. 9A, the leading edge of the arm portion 212*b* of the lock release lever 212 rotates along the locus M illustrated in FIG. 9A.

Therefore, the arm portion 212*b* of the lock release lever 212 comes into conflict with the lock pin 204 which is applied by an elastic force of the compression spring 205 toward the lower side of FIG. 9A. At this time, the arm portion 212*b* of the lock release lever 212 receives the repulsion force from the lock pin 204, and the lock release lever 212 rotates about the rotation shaft 212*a* in a direction of arrow +r2 in FIG. 9A.

However, since the lock release lever 212 abuts onto the abutting portion 210*b* of the lever body portion 210 and is regulated in its rotation, the lock release lever 212 is not allowed to rotate. Therefore, the lever body portion 210 holding the rotation shaft 212*a* of the lock release lever 212 is also not allowed to rotate about the rotation shaft 210*a*, and enters the lock state.

In other words, the regulation unit of the embodiment includes the lever body portion 210 which is rotatable about the rotation shaft 210*a* (a first rotation shaft).

Further, there is provided the lock release lever 212 which is rotatable about the rotation shaft 212*a* (a second rotation shaft) provided in the lever body portion 210.

Further, there is provided the lock pin 204 included in the regulation unit. The lock pin 204 is engaged with the leading edge of the arm portion 212*b* of the lock release lever 212 which rotates about the rotation shaft 210*a* of the lever body portion 210. Further, the lock pin 204 (a regulation portion) does not interfere with the leading edge of the arm portion 212*b* of the lock release lever 212 which rotates about the rotation shaft 212*a* of the lock release lever 212.

Then, as illustrated in FIG. 9A, the regulation unit is provided with a first position at which the lock release lever 212 of the sensor lever 201 is prevented from rotating in the same direction (a direction of arrow −r2 in FIG. 9A) when the lock release lever 212 is pushed by the sheet S.

Further, as illustrated in FIGS. 9B and 9C, there is provided a second position at which the lock release lever 212 of the sensor lever 201 is allowed to rotate when the lock release lever 212 is pushed by the sheet S.

Then, there is provided the lock release lever 212 which is movable between the first position and the second position. Then, when the lock release lever 212 is moved from the first position illustrated in FIG. 9A to the second position illustrated in FIGS. 9B and 9C by the sheet S, the rotation prevention by the regulation unit is released.

<Release of Regulation Unit>

Next, a process in which the regulation unit is released by the sheet S will be described. The urging force which is applied by the torsion coil spring 211 to the lever body portion 210 to rotate about the rotation shaft 210*a* in a direction of arrow +r1 in FIG. 8 is larger than the urging force which is applied by the torsion coil spring 213 to the lock release lever 212 to rotate about the rotation shaft 212*a* in a direction of arrow +r2 in FIG. 8.

Therefore, as illustrated in FIG. 9B, when the leading end of the sheet S abuts onto the lock release lever 212, the lock release lever 212 begins to independently rotate about the rotation shaft 212*a* in a direction of arrow −r2 in FIG. 9B against the urging force of the torsion coil spring 213.

The leading edge of the arm portion 212*b* of the lock release lever 212 rotates along the locus N illustrated in FIG. 9A. Therefore, the arm portion 212*b* of the lock release lever 212 does not interfere with the lock pin 204, and the lock release lever 212 rotates about the rotation shaft 212*a* in a direction of arrow −r2 in FIG. 9B. At this time, the arm portion 212*b* of the lock release lever 212 is at a position where the arm portion 212*b* does not interfere with the lock pin 204. Therefore, the lever body portion 210 enters the lock released state where the lever body portion 210 is rotatable about the rotation shaft 210*a*.

Further, as illustrated in FIG. 9B, when the sheet S is conveyed, the arm portion 212*b* of the lock release lever 212 rotates to a position abutting onto an abutting portion 210*c*1 of the flag portion 210*c* of the lever body portion 210. Then, as illustrated in FIG. 9C, the lock release lever 212 and the lever body portion 210 are united into one body and begin to rotate about the rotation shaft 210*a* of the lever body portion 210 in a direction of −r1 in FIG. 9C.

Then, the flag portion 210*c* provided in the lever body portion 210 goes into the light path formed between the light emitting element and the light receiving element of the photo interrupter 203 to block the light path, and a sensor signal generated from the photo interrupter 203 is changed from ON to OFF. When receiving the signal, the controller 1 determines that the leading end of the sheet S is arrived.

Figures 10A, 10B, 10C:
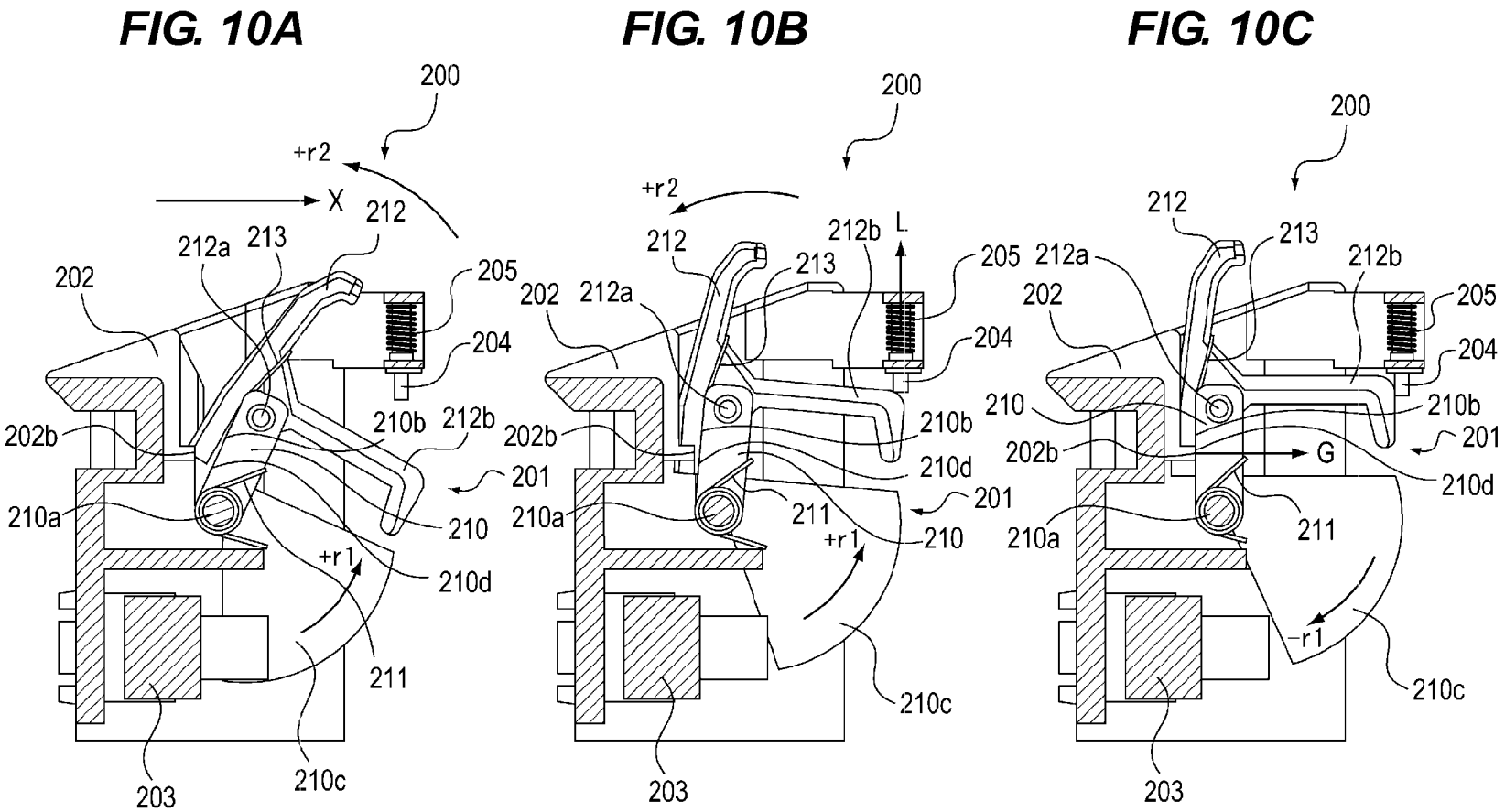
FIG. 10A is a cross-sectional view for describing an operation in which the sensor lever and the lock release lever of the second embodiment return to a home position.
FIG. 10B is a cross-sectional view for describing an operation in which the sensor lever and the lock release lever of the second embodiment return to the home position.
FIG. 10C is a cross-sectional view for describing an operation in which the sensor lever and the lock release lever of the second embodiment return to the home position.

Next, a process in which the sensor lever 201 returns to the standby state after the sheet S passes through the sheet detecting apparatus 200 will be described. FIGS. 10A to 10C illustrate states where the sheet S passes through the sheet detecting apparatus 200 and the sensor lever 201 returns to the standby state illustrated in FIG. 10C. FIG. 10A illustrates a state immediately after the sheet S passes through the sheet detecting apparatus 200. FIG. 10B illustrates a state in which the leading edge of the arm portion 212*b* of the sensor lever 201 abuts onto the leading edge of the lock pin 204. FIG. 10C illustrates a state in which the sensor lever 201 returns to the standby state and is locked by the regulation unit.

As illustrated in FIG. 10A, a process immediately after the sheet S passes through the sheet detecting apparatus 200 is as follows.

That it, the lever body portion 210 and the lock release lever 212 begin to rotate about the rotation shafts 212*a* and 210*a* in directions of arrows +r2 and +r1 in FIG. 10A by the urging forces of the torsion coil spring 211 and the torsion coil spring 213, respectively.

In the embodiment, weights of the lever body portion 210 and the lock release lever 212, and spring pressures of the torsion coil spring 211 and the torsion coil spring 213 are set to predetermined values.

Therefore, the lock release lever 212 is configured to return to a position abutting onto the abutting portion 210*b* of the lever body portion 210 before the lever body portion 210 returns to the home position illustrated in FIG. 10C.

In FIG. 10B, after the lock release lever 212 returns and abuts onto the abutting portion 210*b* of the lever body portion 210, the lock release lever 212 and the lever body portion 210 are united into one body and rotate about the rotation shaft 210*a* in a direction of arrow +r1 in FIG. 10B.

Then, the leading edge of the arm portion 212*b* of the lock release lever 212 abuts onto the leading edge of the lock pin 204.

An urging force which is applied by the compression spring 205 to the lock pin 204 illustrated in FIG. 10B is set to be sufficiently smaller than those of the torsion coil springs 211 and 213.

Therefore, the lock pin 204 is pushed by the arm portion 212*b* of the lock release lever 212 which rotates integrally with the lever body portion 210 rotating about the rotation shaft 210*a* in a direction of arrow +r1 in FIG. 10B. Then, the lock pin 204 retracts in a direction of arrow L in FIG. 10B.

When the lock pin 204 is pushed and retracts in a direction of arrow L in FIG. 10B, the leading edge of the arm portion 212*b* of the lock release lever 212 moves on the locus M illustrated in FIG. 9A and goes through the lock pin 204. Therefore, a stretching force of the compression spring 205 causes the lock pin 204 to return to the initial position protruding downward as illustrated in FIG. 10C. Then, the lever body portion 210 comes into conflict with the stopper 202*b* provided in the supporting member 202 by the urging force of the torsion coil spring 211.

As illustrated in FIG. 10C, the sensor lever 201 is urged to rotate about the rotation shaft 210*a* in a direction of arrow −r1 in FIG. 10C by a repulsion force G which is applied to the lever body portion 210 from the stopper 202*b*.

However, the leading edge of the arm portion 212*b* of the lock release lever 212 abuts onto and is engaged with the side face of the lock pin 204 which is stretched downward, and thus the rotation in a direction of arrow −r1 in FIG. 10C is not allowed.

In the embodiment, the regulation unit of the lever body portion 210 provided with the flag portion 210*c* which blocks the light path formed between the light emitting element and the light receiving element of the photo interrupter 203 includes the lock release lever 212 and the lock pin 204 separately from the lever body portion 210.

Then, as illustrated in FIGS. 9A and 10C, when the lever body portion 210 is in the standby state, the arm portion 212*b* of the lock release lever 212 abuts onto and is engaged with the side face of the lock pin 204, so that the lever body portion 210 is held in a manner not rotatable.

On the other hand, when the lever body portion 210 is in the standby state, the lock release lever 212 rotates about the rotation shaft 212*a* in a direction of arrow −r2 in FIG. 9A by the conveying force of the sheet S.

In this case, since the leading edge of the arm portion 212*b* of the lock release lever 212 does not interfere with the lock pin 204, the lock release lever 212 can rotate about the rotation shaft 212*a*.

With this configuration, as illustrated in FIG. 10A, after the sheet S passes through the sheet detecting apparatus 200, the sensor lever 201 which is provided with the lever body portion 210 and the lock release lever 212 returns to the standby state illustrated in FIG. 10C.

At this time, the sensor lever comes into conflict with the stopper 202*b* which regulates the home position of the lever body portion 210 and is urged to rebound.

However, the rebounding is prevented (regulated) by the regulation unit which includes the lock release lever 212 and the lock pin 204. In other words, the lock release lever 212 and the lock pin 204 serving as the regulation unit prevent the vibration of the sensor lever 201 which occurs in returning to the home position in the standby posture by regulating the rotation of the sensor lever 201.

Therefore, it is possible to prevent the chattering phenomenon that the sensor signal generated from the photo interrupter 104 is repeatedly turned on/off.

Further, in the embodiment, the torsion coil spring 211 is used to apply the urging force to the lever body portion 210 of the sensor lever 201.

In other words, the lock release lever 212 of the sensor lever 201 is applied by a force in a direction opposite (a direction of arrow +r2 in FIG. 9A) to the rotating direction (a direction of arrow −r2 in FIG. 9A) of the lock release lever 212 when being pushed by the sheet S.

In addition, the lever body portion 210 of the sensor lever 201 may be configured to be applied by a force using the weights of the lever body portion 210 and the lock release lever 212 of the sensor lever 201.

In other words, the lock release lever 212 of the sensor lever 201 is applied by a force in a direction (a direction of arrow +r2 in FIG. 9A) opposite to the rotating direction (a direction of arrow −r2 in FIG. 9A) of the lock release lever 212 when being pushed by the sheet S. The other configurations are the same as those in the first embodiment, and the same advantages can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-214371, filed Oct. 15, 2013, which is hereby incorporated by reference herein in its entirety.

What is claimed is:

1. A detection apparatus comprising:

a rotating member which rotates in a rotation direction from a standby posture by being pushed by a conveyed sheet;

a sensor of which an output is changed as the rotating member rotates from the standby posture;

an elastic member which elastically applies a force to the rotating member in a direction opposite to the rotation direction;

a first abutting portion which abuts onto the rotating member applied by a force by the elastic member to maintain the rotating member in the standby posture; and a regulation unit which allows the rotating member to rotate in the rotation direction by being pushed by the conveyed sheet and regulates the rotating member not to rotate in the rotation direction by a repulsion force when the rotating member rotated in the opposite direction by an elastic force of the elastic member abuts onto the first abutting portion, wherein the regulation unit includes a second abutting portion which abuts onto the rotating member rotated in the rotation direction by a repulsion force when the rotating member rotated in the opposite direction by the elastic force of the elastic member abuts onto the first abutting portion, and the rotating member includes a second abutted portion which abuts onto the second abutting portion and the rotating member takes a regulating posture in which the second abutted portion abuts onto the second abutting portion when the rotating member rotates in the rotation direction and thus the rotation of the rotating member is regulated, and an allowing posture in which the second abutted portion does not abut onto the second abutting portion when the rotating member rotates in the rotation direction.

2. The detection apparatus according to claim 1, wherein the rotating member changes its posture from the regulating posture to the allowing posture when the rotating member is pushed by the conveyed sheet.

3. The detection apparatus according to claim 1, further comprising a shaft which rotatably supports the rotating member, wherein the regulation unit includes a supporting member which supports the shaft to be movable in a conveyance direction of the sheet.

4. The detection apparatus according to claim 3, wherein the supporting member includes a first hole which supports one side of the shaft and a second hole which supports the other side of the shaft, and the other side of the shaft is movable in the conveyance direction with respect to the one side of the shaft when the rotating member is pushed by the conveyed sheet.

5. The detection apparatus according to claim 4, wherein a size of the second hole in the conveyance direction is larger than that of the first hole.

6. The detection apparatus according to claim 1, wherein the rotating member includes a sheet abutting portion which abuts onto a sheet, a blocking portion which changes an output of the sensor, and a first abutted portion which abuts onto the first abutting portion.

7. An image forming apparatus comprising:

the detection apparatus according to claim 1; and an image forming portion which forms an image in the sheet.

8. A detection apparatus comprising:

a rotating member which rotates in a rotation direction from a standby posture by being pushed by a conveyed sheet;

a sensor of which an output is changed as the rotating member rotates from the standby posture;

an elastic member which elastically applies a force to the rotating member in a direction opposite to the rotation direction;

a first abutting portion which abuts onto the rotating member applied by a force by the elastic member to maintain the rotating member in the standby posture; and a regulation unit which allows the rotating member to rotate in the rotation direction by being pushed by the conveyed sheet and regulates the rotating member not to rotate in the rotation direction by a repulsion force when the rotating member rotated in the opposite direction by an elastic force of the elastic member abuts into the first abutting portion, wherein the regulation unit includes a lever body portion which is rotatable about a first rotation shaft, a lock release lever which is rotatable about a second rotation shaft provided in the lever body portion, and a regulation portion which is engaged with the lock release level rotating about the first rotation shaft and does not interfere with the lock release lever rotating about the second rotation shaft.

* * * * *